US012458134B2

(12) United States Patent
McCarthy

(10) Patent No.: US 12,458,134 B2
(45) Date of Patent: Nov. 4, 2025

(54) FOLDING BROOM-CLEANING-STORAGE APPARATUS

(71) Applicant: John McCarthy, Braintree, MA (US)

(72) Inventor: John McCarthy, Braintree, MA (US)

( * ) Notice: Subject to any disclaimer, the term of this patent is extended or adjusted under 35 U.S.C. 154(b) by 575 days.

(21) Appl. No.: 17/465,997

(22) Filed: Sep. 3, 2021

(65) Prior Publication Data

US 2023/0070832 A1 Mar. 9, 2023

(51) Int. Cl.

| | |
|---|---|
| ***A46B 5/00*** | (2006.01) |
| ***A46B 9/02*** | (2006.01) |
| ***A46B 15/00*** | (2006.01) |
| ***A46D 1/00*** | (2006.01) |
| ***A47L 13/52*** | (2006.01) |

(52) U.S. Cl.

CPC ..... *A46B 5/0045* (2013.01); *A46B 5/0054* (2013.01); *A46B 9/02* (2013.01); *A46B 15/0095* (2013.01); *A46D 1/0253* (2013.01); *A47L 13/52* (2013.01); *A46B 2200/302* (2013.01)

(58) Field of Classification Search

CPC ..... A46B 15/0095; A46B 2200/302; A46B 7/044; A47L 13/52; A46D 1/0253

USPC ..... 15/257.2, 176.6; D4/136; 56/400.17, 56/400.21

See application file for complete search history.

(56) References Cited

U.S. PATENT DOCUMENTS 2,300,729 A * 11/1942 Kemmer ..... A01D 7/06 56/400.17
4,707,892 A * 11/1987 Nelson ..... F16B 7/0433 24/336
5,386,839 A * 2/1995 Chen ..... A46B 7/02 132/160
6,108,854 A * 8/2000 Dingert ..... A46B 9/02 15/159.1
6,128,800 A * 10/2000 Vosbikian ..... A46B 5/0075 403/97
8,438,689 B2 * 5/2013 Noble ..... A46D 1/02 15/171
11,103,757 B2 * 8/2021 Lyons ..... A63B 60/32
2004/0134803 A1 * 7/2004 Michelson ..... A47L 13/52 15/257.7
2006/0200924 A1 * 9/2006 Hampton ..... A46B 5/0033 15/144.3

(Continued)

FOREIGN PATENT DOCUMENTS

KR 20-2019-0003163 * 12/2019 ..... A47L 13/52

OTHER PUBLICATIONS

KR 20190003163.*

*Primary Examiner* — Laura C Guidotti
(74) *Attorney, Agent, or Firm* — Law Office of Matthew M. Yospin; Matthew M. Yospin

(57) ABSTRACT

Improved folding broom-cleaning-storage apparatus for cleaning are provided. The folding broom-cleaning-storage apparatus comprises components to form a variety of broom configurations. The apparatus comprises folding components which may be assembled and disassembled quickly and simply. The apparatus comprises a case which may be used as a separate dustpan, and which may be connected to the broom configurations for use, and which may store the broom components when the broom components are disassembled. The apparatus may comprise shaped bristles, which may be arranged in layers, and offer improvements in efficiency when used.

2 Claims, 18 Drawing Sheets

(56) References Cited

U.S. PATENT DOCUMENTS

2018/0344119 A1* 12/2018 Mengstu ..... A47L 13/12
2021/0137255 A1* 5/2021 Ohayon ..... A46D 1/006

* cited by examiner

FOLDING BROOM-CLEANING-STORAGE APPARATUS

FIELD OF THE INVENTION

The presently disclosed subject matter relates to brooms and cleaning, and more particularly, to a multi-purpose folding broom, cleaning, and storage apparatus, that allow a folding broom apparatus to be used in a variety of forms for cleaning and sweeping, and compactly stored.

BACKGROUND OF THE INVENTION

A variety of sizes and shapes of brooms, including long-handled floor brooms, whisk brooms, and desk brooms or hand brooms, are known to exist. Likewise, a variety of related cleaning tools used along with brooms, including dustpans and sweepers and lobby brooms—a broom with a mid-length handle and a dustpan with a hinged portion to which a mid-length handle is attached—are known to exist and commonly used. These various broom and dustpan tools work for their purposes, but have multiple shortcomings. Typical prior art is not a multi-function tool: it is a long-handled floor broom, or a lobby broom, or whisk broom with a short handle, or a brush head with little or no elongated handle, or a hand sweeper (with the handle perpendicular to the arrangement of the bristles). Prior art devices include US Patent Application 2007089255, to Michelson et al for a "Kit for multi-piece floor cleaning implement"; U.S. Pat. No. 9,107,490, to Lafleur and Bussiere, for a "Multi-axis articulated implement"; U.S. Pat. No. 9,204,714, to Coste, for a "Collapsible cleaning device"; WIPO Publication 2011044875, to Sanzo for a "Multi-purpose cleaning device"; and US Patent Application 2018344119 to Mengstu for a "Broom and mop combination systems"; all of which present shortcomings improved upon by the present disclosure.

For a person or business to have the use of multiple of these types of tools, they must have one of each type. As the tools serve different functions, a person or business may have multiple related tools, and then need to store them, which imposes costs in required space and organization. If the person must travel with them, this imposes further costs—brooms typically have handles that make transporting them not simple, as they don't fit readily in most vehicles, or in bags or storage bins. In addition, most brooms and related tools do not fit well with the other tool typically used and desired for cleaning: a dustpan or similar receptacle, for sweeping up the refuse with the broom, and having a convenient apparatus to pick it up with from the floor or other surface.

For these reasons, a need exists for a multi-function broom, that can be configurable into a variety of sizes and configurations. A need exists for a broom that can be easily stored and easily transported. A need exists for a broom-and-dustpan combination that will keep the broom and the dustpan together, and allow them to be stored, transported, and used in cleanup readily and simply.

SUMMARY OF THE INVENTION

The present invention meets all these needs, by disclosing apparatus for multi-purpose folding broom, cleaning, and storage. In one aspect of the present disclosure, the disclosed apparatus allows people to compactly store and/or easily transport a folding multi-purpose broom. In another aspect, the present disclosure allows people to use a single broom apparatus in a variety of configurations, suitable for a range of uses or application of a broom, sweeper, cleaner, whisk broom, or other type of sweeping or cleaning apparatus, without need for multiple tools. Furthermore, in another aspect of the present disclosure, the disclosed apparatus allows for a sweeping receptacle or dustpan, which may be used to easily clean up an area and dispose of any refuse, and which may be affixed to the broom apparatus while in use. This represents significant improvements over the current art, in which multiple tools would be needed for different types of broom or cleaning tasks, including dustpans or other sweeping receptacles, and in which the tools could not be compactly stored or transported.

In some aspects, the apparatus described herein includes a case including a bottom, a first side, a second side, a back-side, a top, a cover, and a cover-handle receiver; the case including a front opening; and wherein the cover is rotatably affixed to the case with a cover hinge; a handle, the handle including: a proximal end and a handle-cover coupler situated at the proximal end; a distal end and a handle-brush coupler situated at the distal end; and a plurality of handle-sections which are hollow; and a handle-elastic-item running through the plurality of handle-sections; and a brush, the brush including: a plurality of bristles; a brush frame; and a brush-handle shaft; and a brush axis; wherein the brush-handle shaft reversibly couples with the handle-brush coupler.

In some aspects, the apparatus described herein includes a brush further includes a locking brush-handle hinge and a hinge release.

In some aspects, the apparatus described herein includes a handle has affixed to it a plurality of handle clips.

In some aspects, the apparatus described herein includes a brush is reversibly attached to and removed from the handle, using the handle-brush coupler and the brush-handle shaft.

In some aspects, the apparatus described herein includes a handle is reversibly attached to and removed from the case, using the handle-cover coupler and the cover-handle receiver.

In some aspects, the apparatus described herein includes a handle is used in a floor-sweeper configuration, with the case attached to the handle.

In some aspects, the apparatus described herein includes a handle is used as a full-height broom.

In some aspects, the apparatus described herein includes a plurality of handle-sections may be folded to a total length of just one or a small number of the plurality of handle-sections.

In some aspects, the apparatus described herein includes a plurality of bristles includes a plurality of shaped bristles.

In some aspects, the apparatus described herein includes a plurality of shaped bristles includes an elastic material.

In some aspects, the apparatus described herein includes each of the plurality of shaped bristles includes a top, a bottom, a first side, a second side, a first surface, and a second surface, and the plurality of shaped bristles are attached at the top of each of the plurality of shaped bristles to each other, including a layer of the plurality of shaped bristles.

In some aspects, the apparatus described herein includes at the bottom of each of the plurality of shaped bristles, at least some of the plurality of shaped bristles are attached to one or more adjacent of the plurality of shaped bristles.

In some aspects, the apparatus described herein includes at least some of the plurality of shaped bristles are attached to each other in a pattern.

In some aspects, the apparatus described herein includes a plurality of shaped bristles includes a plurality of layer-end-bristles, wherein the plurality of layer-end-bristles include a bristle-outer-brace-portion.

In some aspects, the apparatus described herein includes a brush includes a plurality of layers, and wherein at least some of the plurality of shaped bristles have a handedness of the layer, and wherein some or all of the plurality of layers may be arranged with the handedness in a particular orientation or orientations.

In some aspects, the apparatus described herein includes a brush includes a plurality of layers, and each of the plurality of layers includes a layer top, together a plurality of layer tops; and wherein the brush frame includes a plurality of layer-top-retainers, wherein each of the plurality of layer tops and at least one of the plurality of layer-top-retainers are disposed to securely and reversibly fit together, and wherein the brush frame includes a brush-bristle-stop-end and a brush-bristle-open-end.

In some aspects, the apparatus described herein includes a case including a cover, a cover-handle receiver, and a front opening; and wherein the cover is rotatably affixed to the case with a cover hinge; a handle, the handle including: a proximal end and a handle-cover coupler situated at the proximal end; a distal end and a handle-brush coupler situated at the distal end; and a plurality of handle-sections which are hollow; and a handle-elastic-item running through the plurality of handle-sections; and a brush, the brush including: a plurality of shaped bristles; a brush frame; and a brush-handle shaft; and a brush axis; wherein the brush-handle shaft reversibly couples with the handle-brush coupler; wherein each of the plurality of shaped bristles include a top and a bottom, and wherein at least some of the plurality of shaped bristles include a layer of the plurality of shaped bristles.

In some aspects, the apparatus described herein includes a brush includes a plurality of layers, and wherein at least some of the plurality of shaped bristles have a handedness of the layer, and wherein some or all of the plurality of layers may be arranged with the handedness in a particular orientation or orientations.

In some aspects, the apparatus described herein includes each of the plurality of layers includes a layer top, together a plurality of layer tops; and wherein the brush frame includes a plurality of layer-top-retainers, wherein each of the plurality of layer tops and at least one of the plurality of layer-top-retainers are disposed to securely and reversibly fit together.

In some aspects, the apparatus described herein includes a brush frame, a plurality of layer-top-retainers, and a plurality of shaped bristles; and wherein each of the plurality of shaped bristles include a top and a bottom, and wherein at least some of the plurality of shaped bristles include a layer of the plurality of shaped bristles; and wherein the brush includes a plurality of layers, and wherein each of the plurality of layers includes a layer top; and wherein at least some of the plurality of shaped bristles have a handedness of the layer; and wherein each layer top and at least one of the plurality of layer-top-retainers are disposed to securely and reversibly fit together.

These aspects of the present disclosure, and others disclosed in the Detailed Description of the Drawings, represent improvements on the current art. This summary is provided to introduce a selection of concepts in a simplified form that are further described below in the Detailed Description of the Drawings. This Summary is not intended to identify key features for essential features of the claimed subject matter, nor is it intended to be used to limit the scope of the claimed subject matter.

BRIEF DESCRIPTION OF THE DRAWINGS

The foregoing summary, as well as the following detailed description of various aspects, is better understood when read in conjunction with the appended drawings. For the purposes of illustration, there is shown in the drawings exemplary aspects; but the presently disclosed subject matter is not limited to the specific methods and instrumentalities disclosed. In the drawings, like reference characters generally refer to the same components or steps of the device throughout the different figures. In the following detailed description, various aspects of the present invention are described with reference to the following drawings, in which.

DETAILED DESCRIPTION OF THE DRAWINGS

Figure 1:
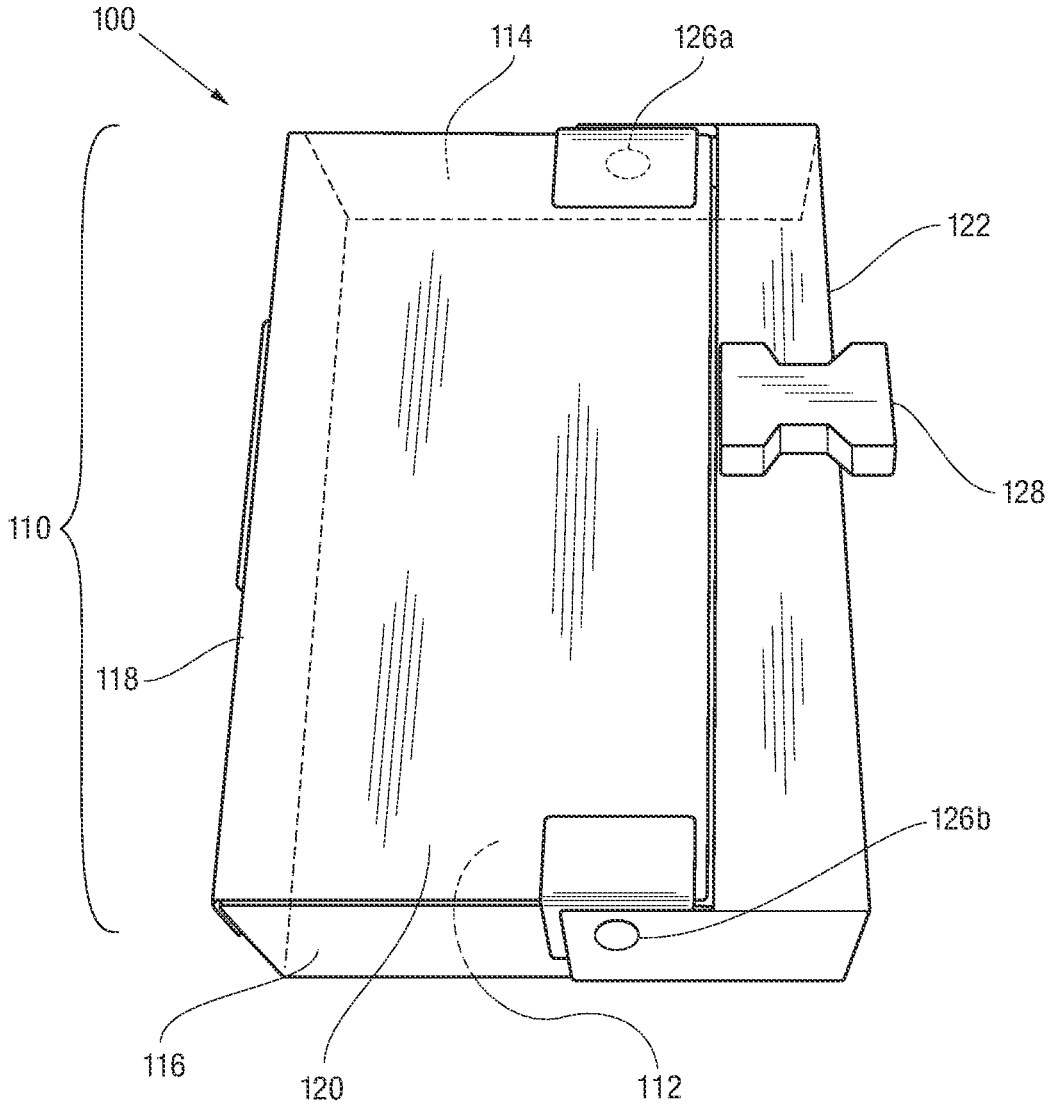
FIG. 1 shows a perspective view of an aspect of the apparatus of the present disclosure.
Figure 2:
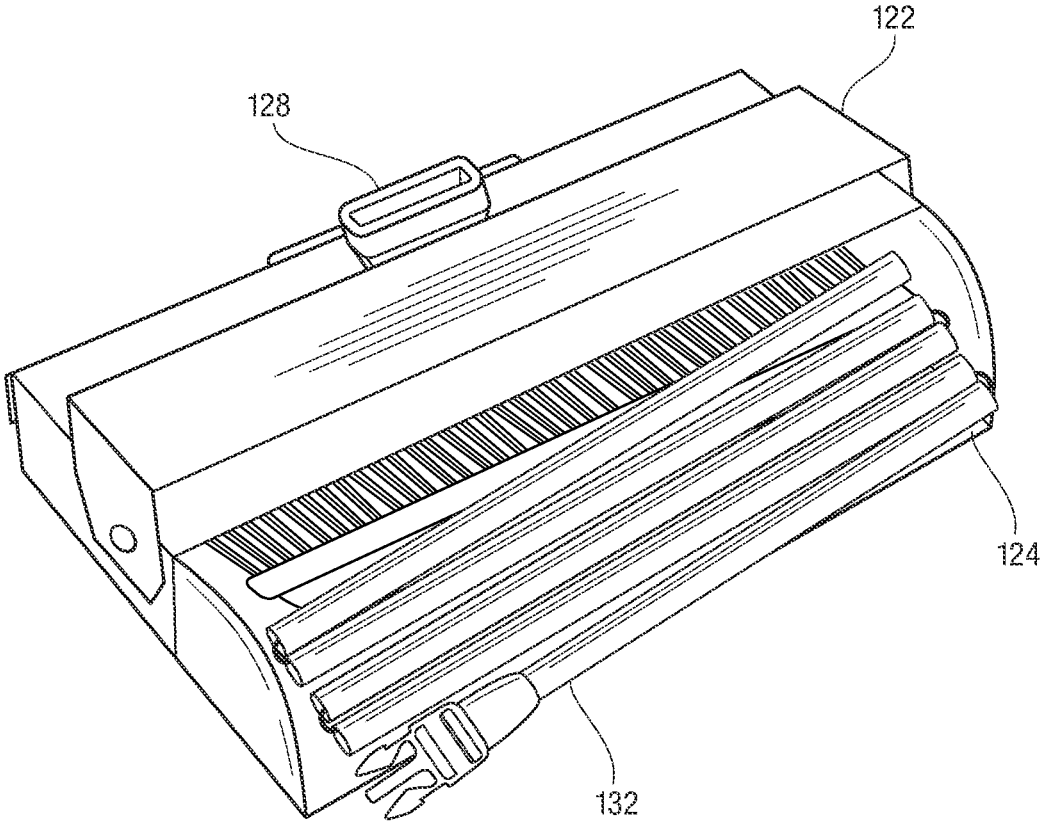
FIG. 2 shows a perspective view of an aspect of the apparatus of the present disclosure, with certain components partially stored within other components.
Figure 3:
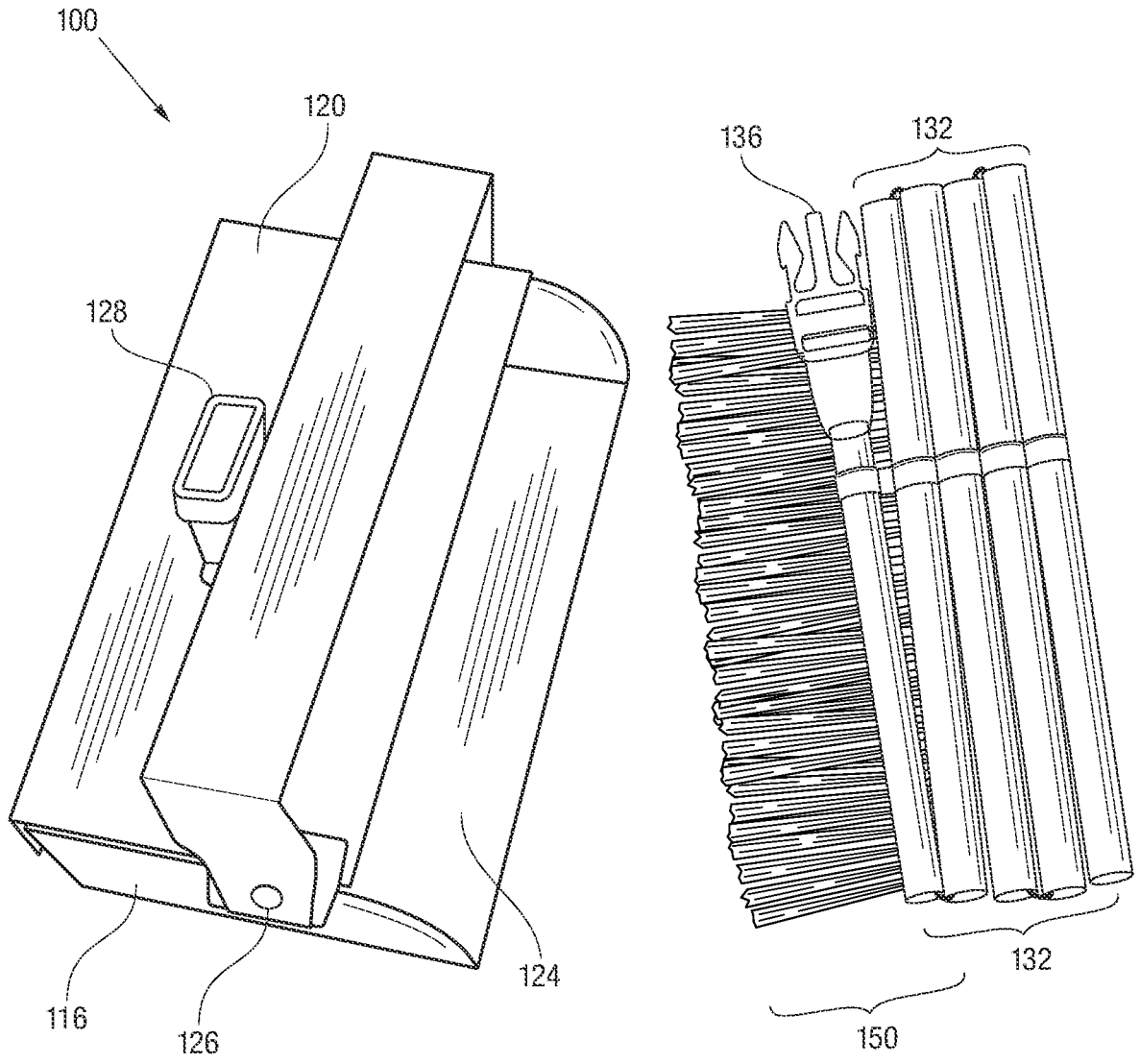
FIG. 3 shows a perspective view of an aspect of the apparatus of the present disclosure, with certain components not stored within other components.
Figure 4:
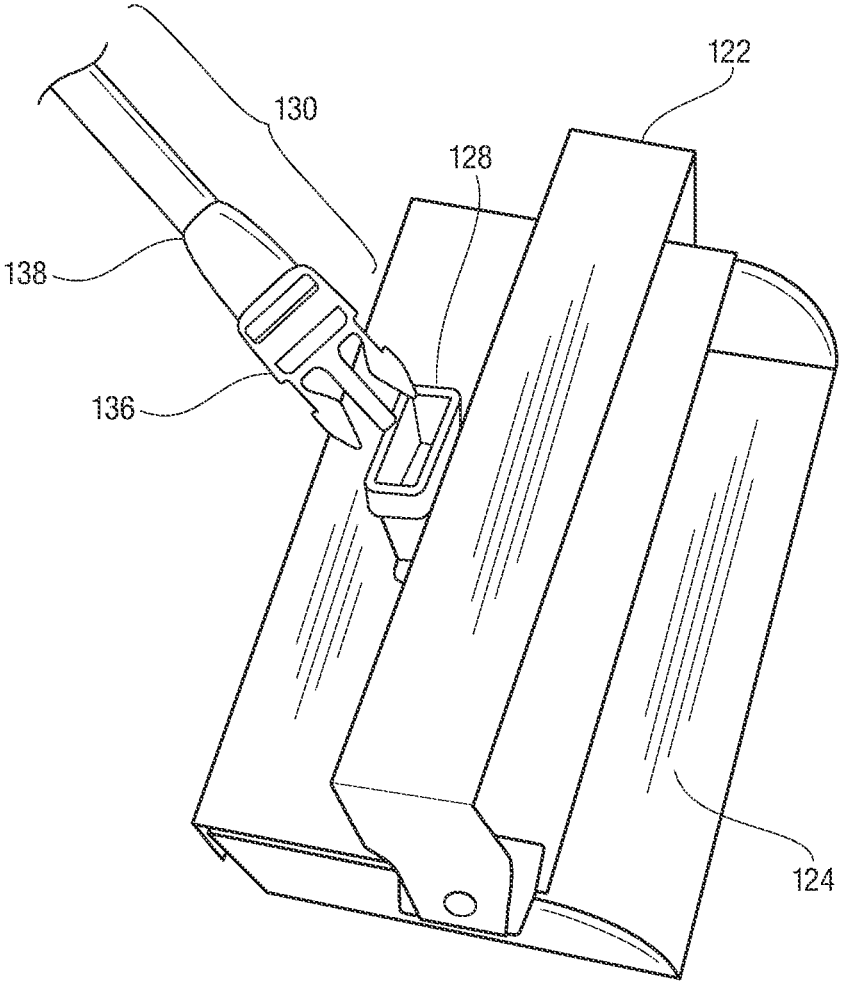
FIG. 4 shows a perspective view of an aspect of the apparatus of the present disclosure, with selected components aligned to be coupled with or decoupled from other components.

The presently disclosed invention is described with specificity to meet statutory requirements. But, the description itself is not intended to limit the scope of this patent. Rather, the claimed invention might also be presented in other aspects, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described. The word "approximately" as used herein means within 5% of a stated value, and for ranges as given, applies to both the start and end of the range of values given. When reference is made to an item, article, component, step, or part of the present disclosure, references to the singular include the plural, and references to the plural include the singular.

In the following description, numerous specific details are set forth to provide a thorough understanding of the invention. But, the present invention may be practiced without these specific details. Structures and techniques that would be known to one of ordinary skill in the art have not been shown in detail, in order not to obscure the invention. Referring to the figures, it is possible to see the various major elements constituting the apparatus of the present invention.

The present subject matter discloses aspects of a folding broom-cleaning-storage apparatus 100. At a high level of overview, the folding broom-cleaning-storage apparatus 100 of the present invention is made, in various aspects, so that the folding broom-cleaning-storage apparatus 100 may be used in a variety of configurations for different desired cleaning tasks, and may be easily stored and transported.

With reference to FIG. 1, FIG. 2, FIG. 3, and FIG. 4, the folding broom-cleaning-storage apparatus 100 comprises a case 110. The case 110 comprises a bottom 112, a first side 114, a second side 116, a back-side 118, a top 120, and a cover 122. The cover 122 may be reversibly opened and closed to reveal or expose a front opening 124 of the case 110. The cover 122 is, in some aspects of the present disclosure, rotatably affixed to other elements of the case 110 with a cover hinge 126. The cover hinge 126 may comprise a first-side hinge 126*a* and a second-side hinge 126*b*. The first-side hinge 126*a* may be located on or affixed to the first side 114, and the second-side hinge 126*b* may be located on or affixed to the second side 116. Other arrangements or types of hinges may be employed for the cover hinge 126, as will be apparent to one of skill in the art. The cover 122 is shown in a closed position relative to the rest of the case 110 in FIG. 1. The cover 122 is shown in an open position relative to the rest of the case 110 in FIG. 2, FIG. 3, and FIG. 4. The cover 122 may be latched in an open position, or the cover hinge 126 may have a catchment to keep the cover 122 in an open position. When the cover 122 is in an open position, the front opening 124 is open to be used for cleaning, or to insert elements of the folding broom-cleaning-storage apparatus 100 for storage inside of the case 110. The cover 122 may be latched in a closed position for secure storage of the folding broom-cleaning-storage apparatus 100. The case 110 further comprises a cover-handle receiver 128. When closed, the case 110 can stand up, lay flat, or hang from a hook.

With reference to FIG. 2, FIG. 3, FIG. 4, FIG. 5, FIG. 6, FIG. 7, FIG. 8, FIG. 9, and FIG. 10, the folding broom-cleaning-storage apparatus 100 comprises a handle 130 and a brush 150. The handle 130 comprises a proximal end 138, proximal to the case 110, and situated at the proximal end 138, the handle 130 comprises a handle-cover coupler 136. The handle 130 comprises a distal end 140, distal from the case 110, and situated at the distal end 140, the handle 130 comprises a handle-brush coupler 142. The handle 130 comprises a plurality of handle-sections 132, each of the plurality of handle-sections 132 is advantageously sized to fit inside the case 110. The plurality of handle-sections 132 comprises individual handle sections, referred to herein as a handle-section 132*a*, a handle-section 132*b*, a handle-section 132*c*, a handle-section 132*d*, a handle-section 132*e*, a handle-section 132*f*, for any number of handle-sections 132.

The plurality of handle-sections 132 are advantageously hollow, and are shaped with an end that is narrower in diameter than the other end of each of the plurality of handle-sections 132, where each of the plurality of handle-sections 132 has its narrow end nearer either the proximal end 138 or the distal end 140, such that the plurality of handle-sections 132 can be reversibly assembled into, and disassembled from, the handle 130 in a variety of configurations, as shown in FIG. 5, FIG. 7, FIG. 8, FIG. 9, and FIG. 10. The handle 130 further comprises a handle-elastic-item 134 running through the plurality of handle-sections 132.

The brush 150 comprises a plurality of bristles 151, a brush frame 154, and a brush-handle shaft 158, wherein the brush-handle shaft 158 reversibly couples with the handle-brush coupler 142. The brush 150 may comprise a locking brush-handle hinge 155 and a hinge release 156.

The handle 130 may have affixed to it a plurality of handle clips 160. The plurality of handle clips 160 may be used to secure any of the plurality of handle-sections 132 to another of the plurality of handle-sections 132 for storage of the folding broom-cleaning-storage apparatus 100 or for use of the folding broom-cleaning-storage apparatus 100. The handle clips 160 may be removed from the handle 130.

The brush 150 comprises a brush axis 152. The brush 150 may be reversibly attached to and removed from the handle 130, using the handle-brush coupler 142 and the brush-handle shaft 158. The brush axis 152 may be parallel to the handle-section 132*a* at the distal end 140, or the brush axis 152 may be perpendicular to the handle-section 132*a* at the distal end 140, or the brush axis 152 and the handle-section 132*a* may be in some other configuration relative to each other.

Figure 5:
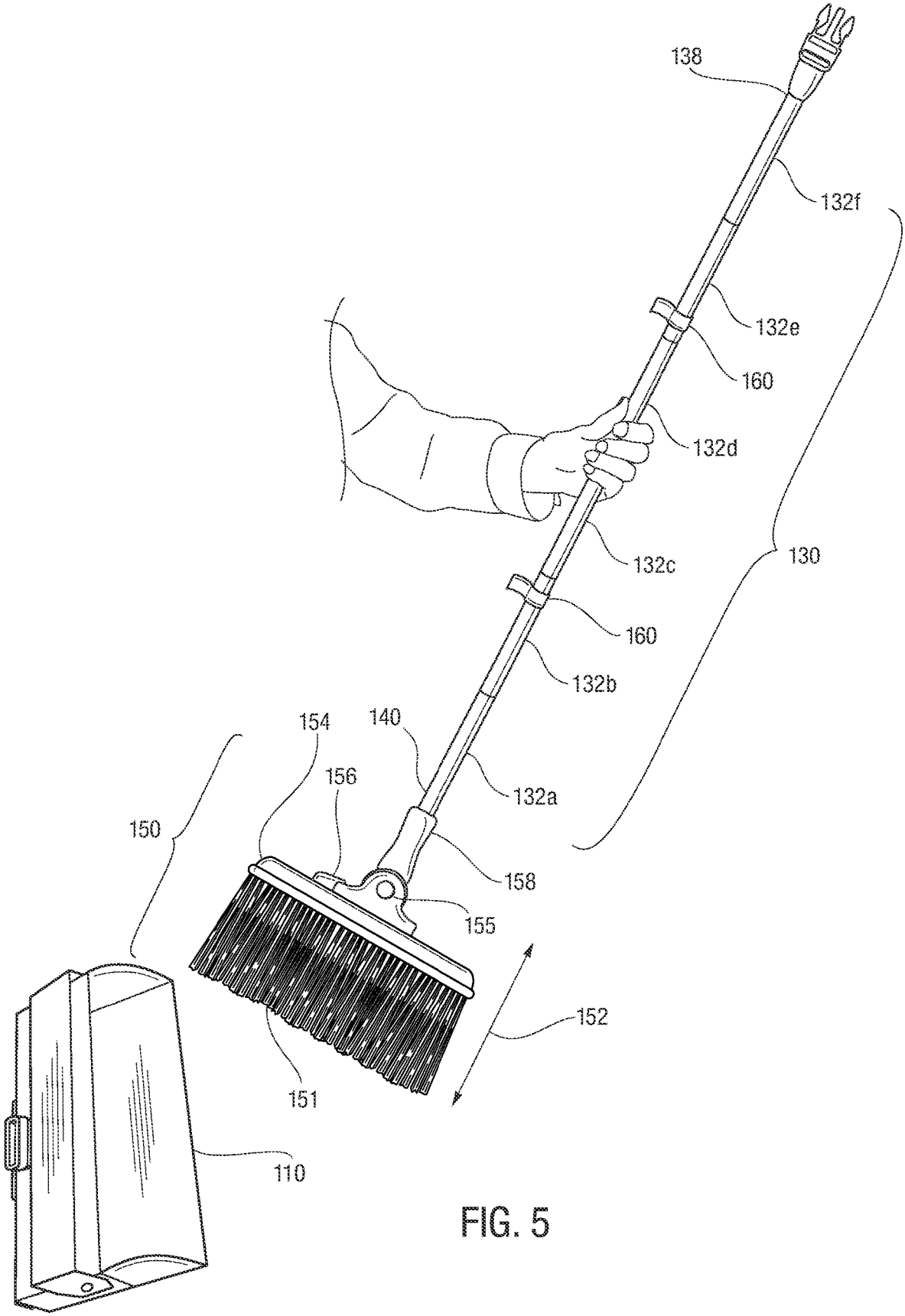
FIG. 5 shows a perspective view of an aspect of the apparatus of the present disclosure, with components assembled for use according to one aspect of the present disclosure.
Figure 6:
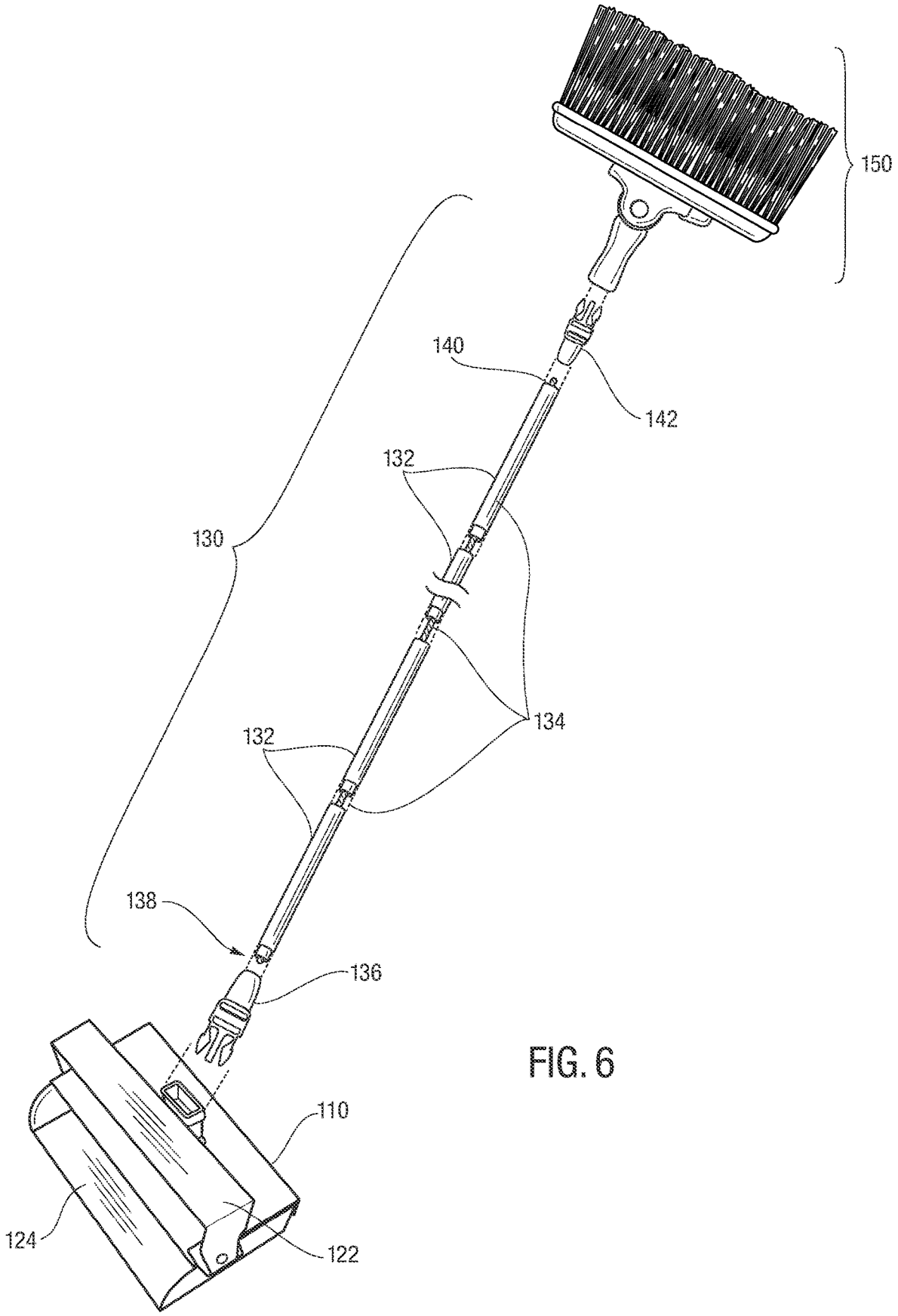
FIG. 6 shows a perspective view of an aspect of the apparatus of the present disclosure, with components separated and aligned to show an aspect of their assembly.
Figure 7:
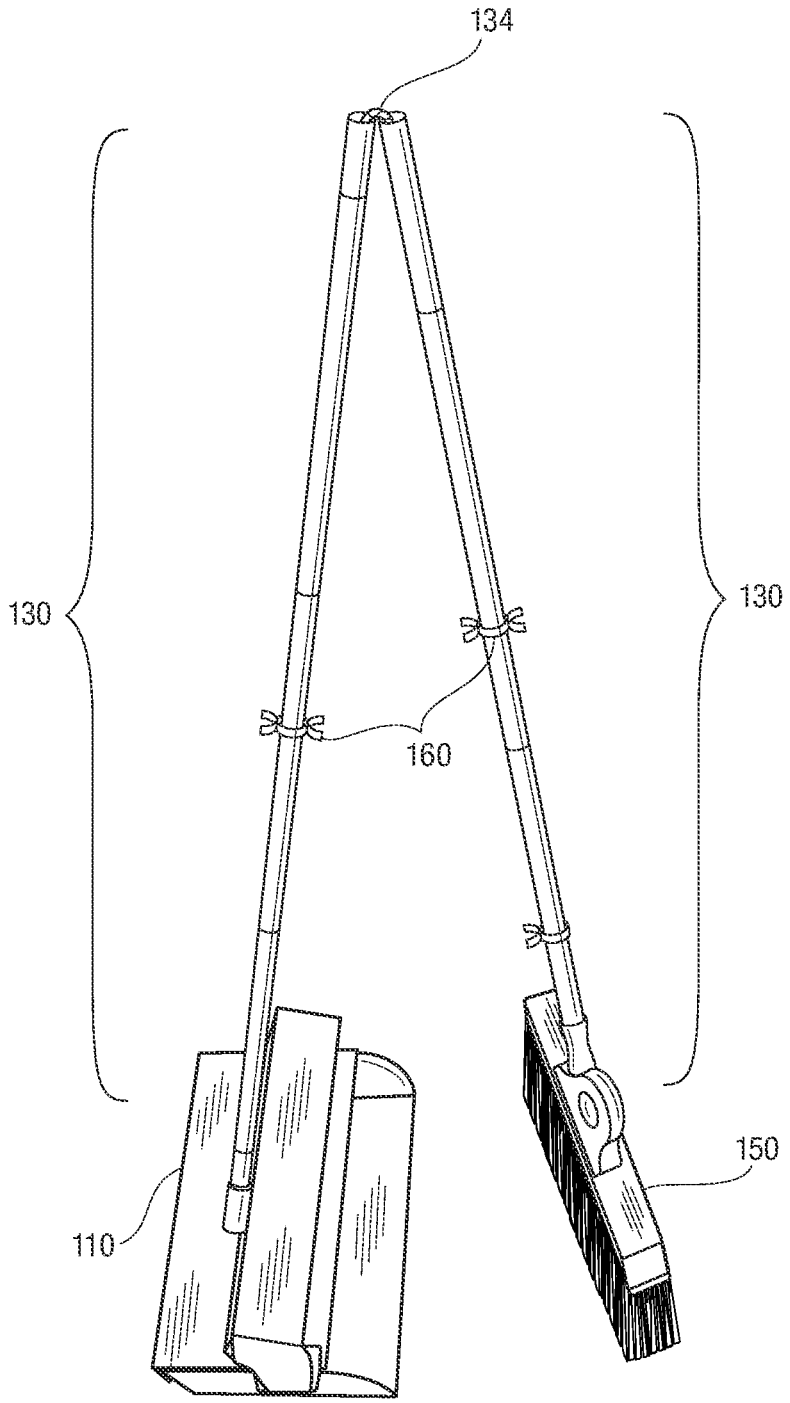
FIG. 7 shows a perspective view of an aspect of the apparatus of the present disclosure, with components assembled for use according to one aspect of the present disclosure.
Figure 8:
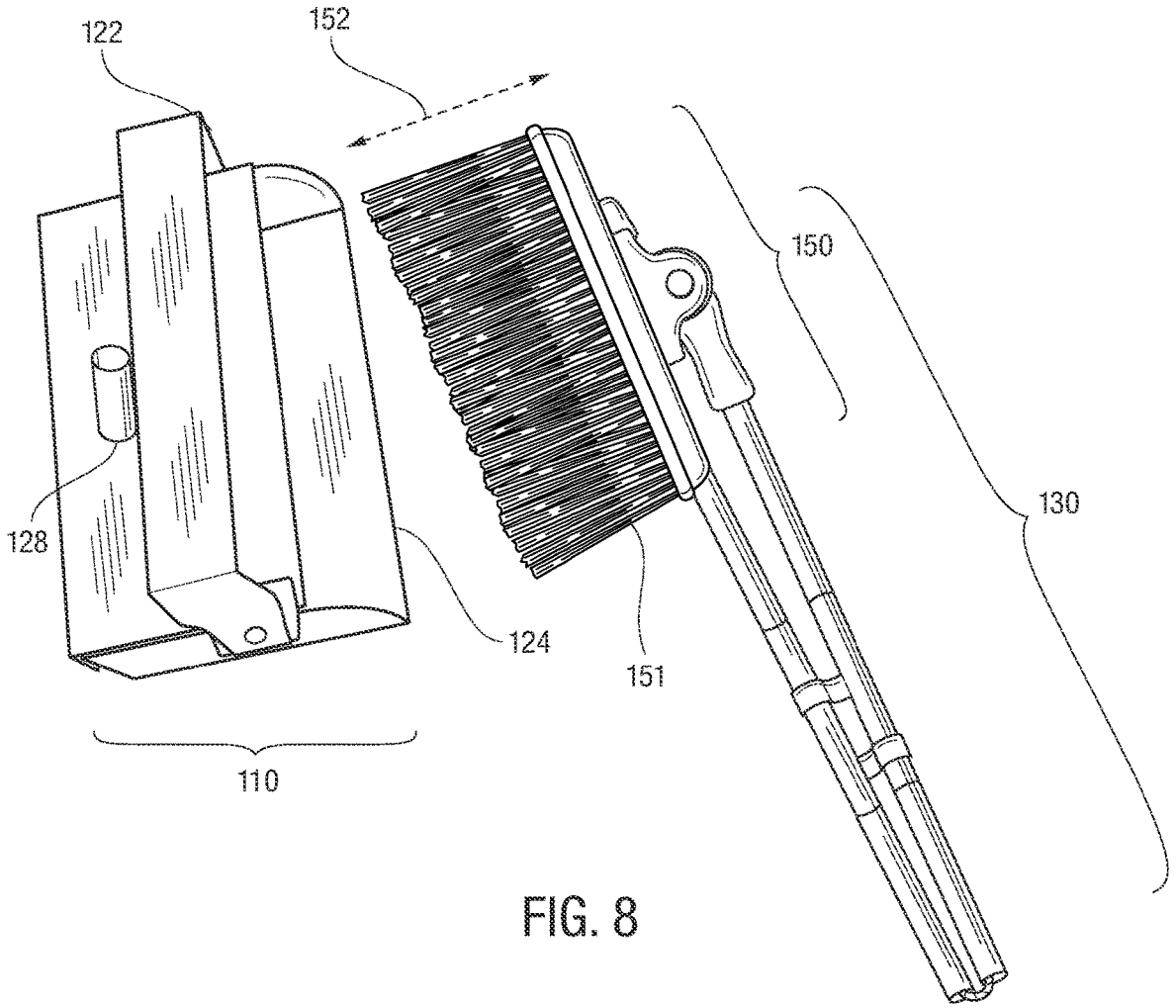
FIG. 8 shows a perspective view of an aspect of the apparatus of the present disclosure, with components assembled for use according to one aspect of the present disclosure.
Figure 9:
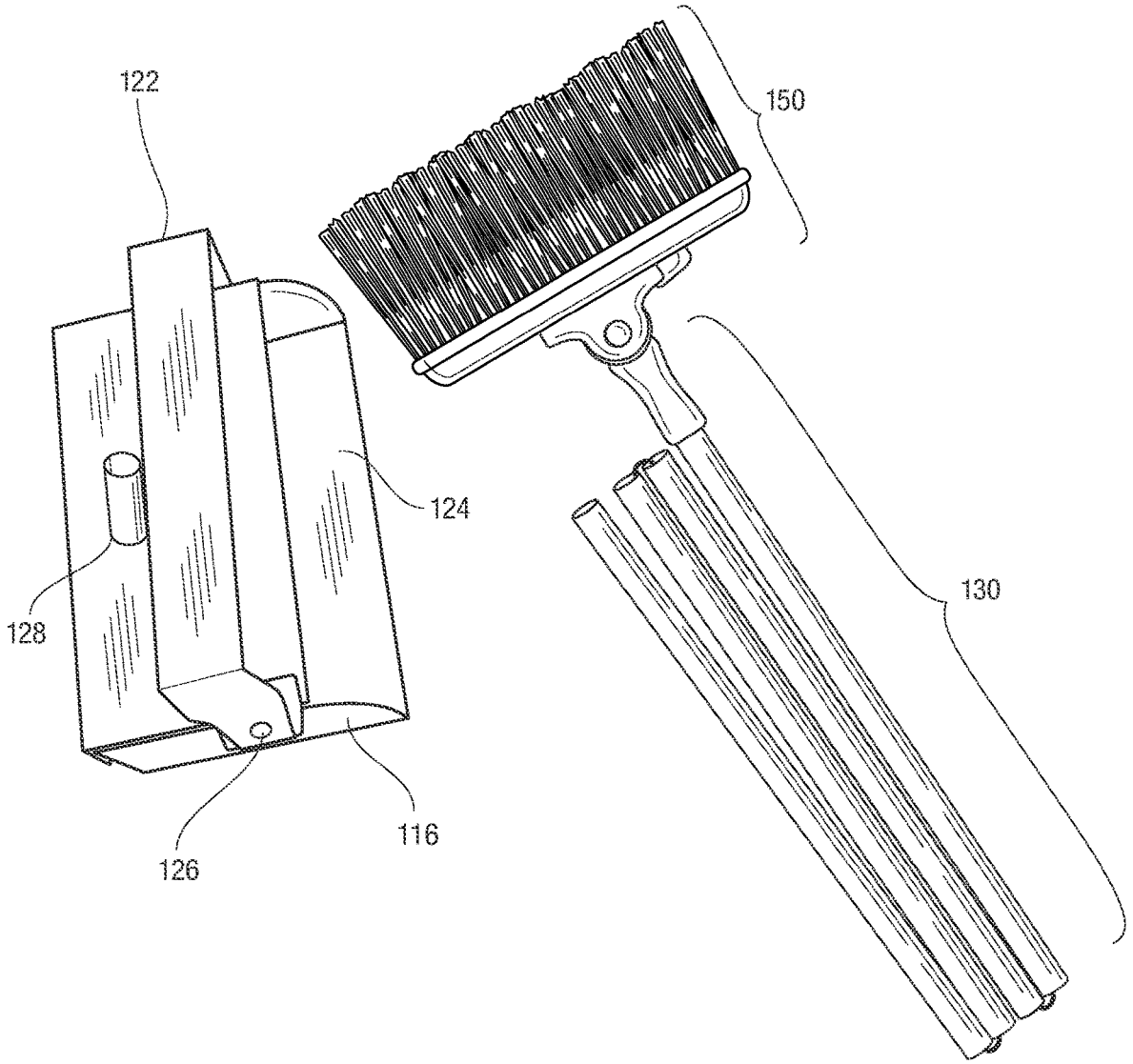
FIG. 9 shows a perspective view of an aspect of the apparatus of the present disclosure, with components assembled for use according to one aspect of the present disclosure.
Figure 10:
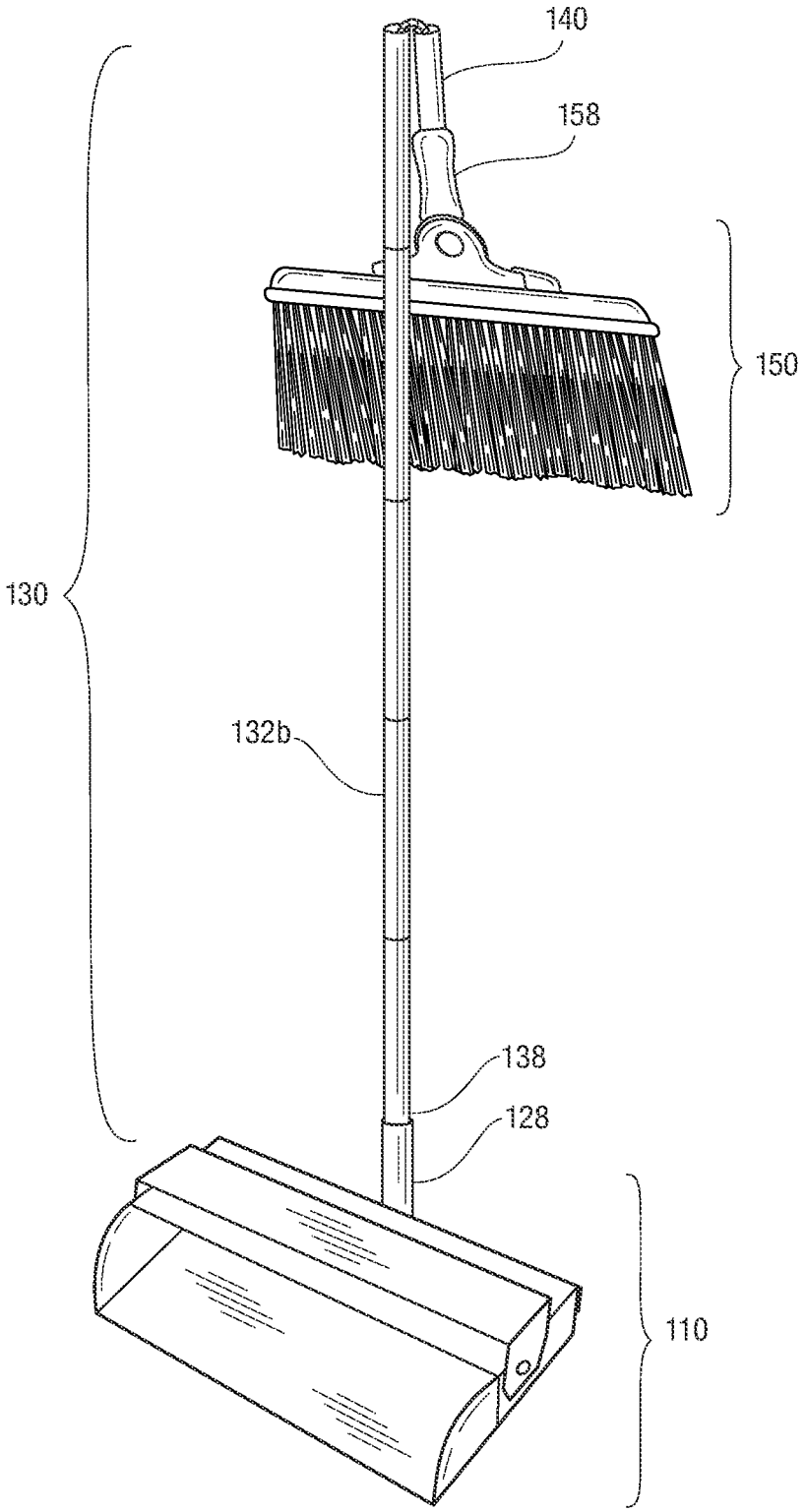
FIG. 10 shows a perspective view of an aspect of the apparatus of the present disclosure, with components assembled for use according to one aspect of the present disclosure.
Figure 11:
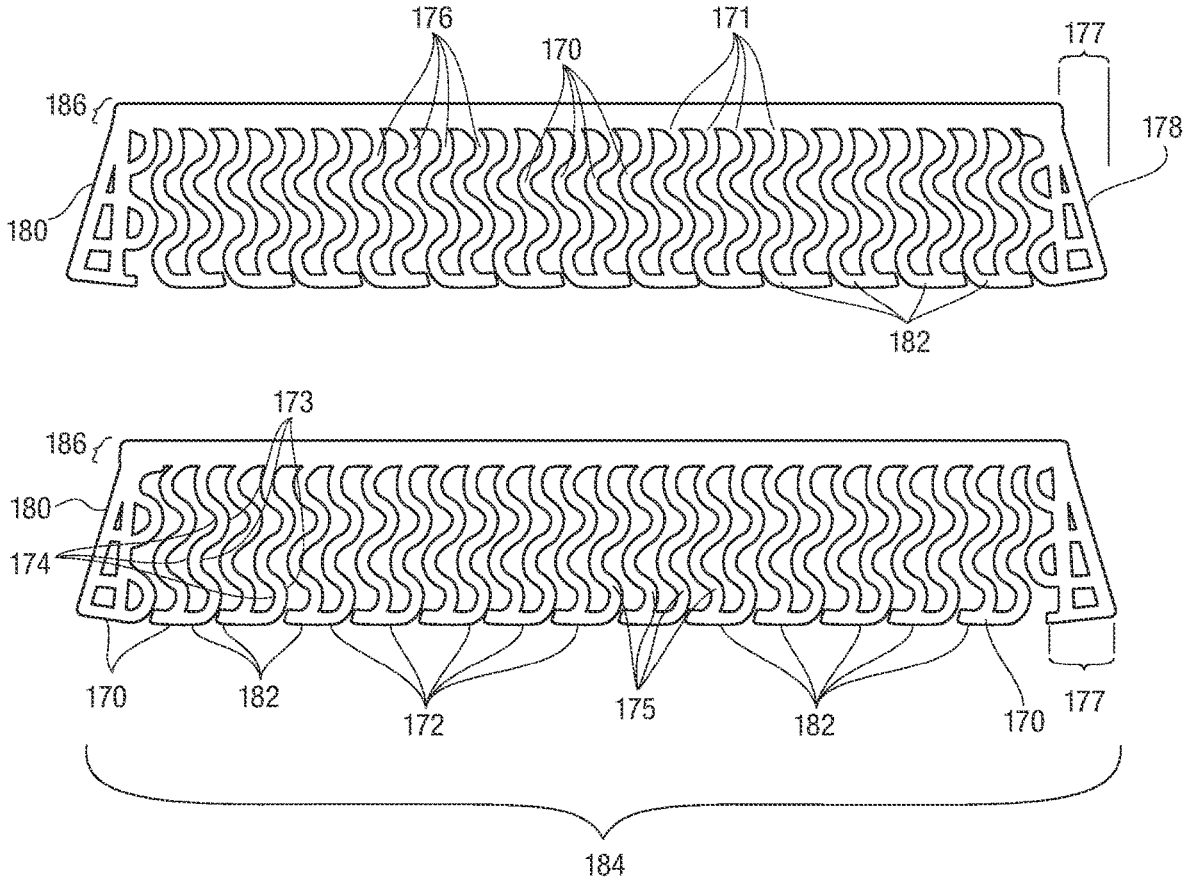
FIG. 11 shows a side plan view of two layers of bristles as an aspect of the present disclosure.

The folding broom-cleaning-storage apparatus 100 may be utilized with the handle 130 attached to the case 110, as shown in FIG. 5, FIG. 7, and FIG. 10, or with the handle 130 not attached to the case 110, as shown in FIG. 8 and FIG. 9, using the handle-cover coupler 136 and the cover-handle receiver 128.

The folding broom-cleaning-storage apparatus 100 and the handle 130 may be used in a floor-sweeper configuration, as for sweeping debris into an attached container, wherein the attached container may be the case 110, such that the case 110 is attached to the handle 130. In a floor-sweeper configuration, the plurality of handle-sections 132 may be folded in approximately the midpoint of the plurality of handle-sections 132. When the handle 130 is in a floor-sweeper configuration, as in FIG. 7, the brush 150 can be folded out of the face of a user 200, as in FIG. 10, so that the user 200 may pick up and empty the case 110 being used as a dustpan, without having the brush 150 in the face of the user 200.

The folding broom-cleaning-storage apparatus 100 and the handle 130 may be used as a full-height broom, as shown in FIG. 5. The handle 130 may be used as a desk broom, a whisk broom, or a floor sweeper. The plurality of handle-sections 132 may be folded to a total length of just one or a small number of the plurality of handle-sections 132, for use of the folding broom-cleaning-storage apparatus 100 as a desk broom or a floor sweeper or a whisk broom configuration, as shown in FIG. 8 and FIG. 9, or for storage of the handle 130 inside of the case 110. In any of these or other configurations of the plurality of handle-sections 132 of the handle 130, the plurality of handle clips 160 may be used to secure the plurality of handle-sections 132 to each other.

With reference to FIG. 11, FIG. 12, FIG. 13, FIG. 14, FIG. 15, FIG. 16, FIG. 17, and FIG. 18, the plurality of bristles 151 may comprise a plurality of shaped bristles 170. In some aspects of the present disclosure, the plurality of shaped bristles 170 may each have the same, or approximately the same, shape. In some aspects of the present disclosure, the plurality of shaped bristles 170 may comprise a variety of shapes. Some of the plurality of shaped bristles 170 may be shaped as flat-in-cross-section "fingers" that have one or more "S" curves. Other shapes of some or all of the plurality of shaped bristles 170 are possible.

Figure 12:
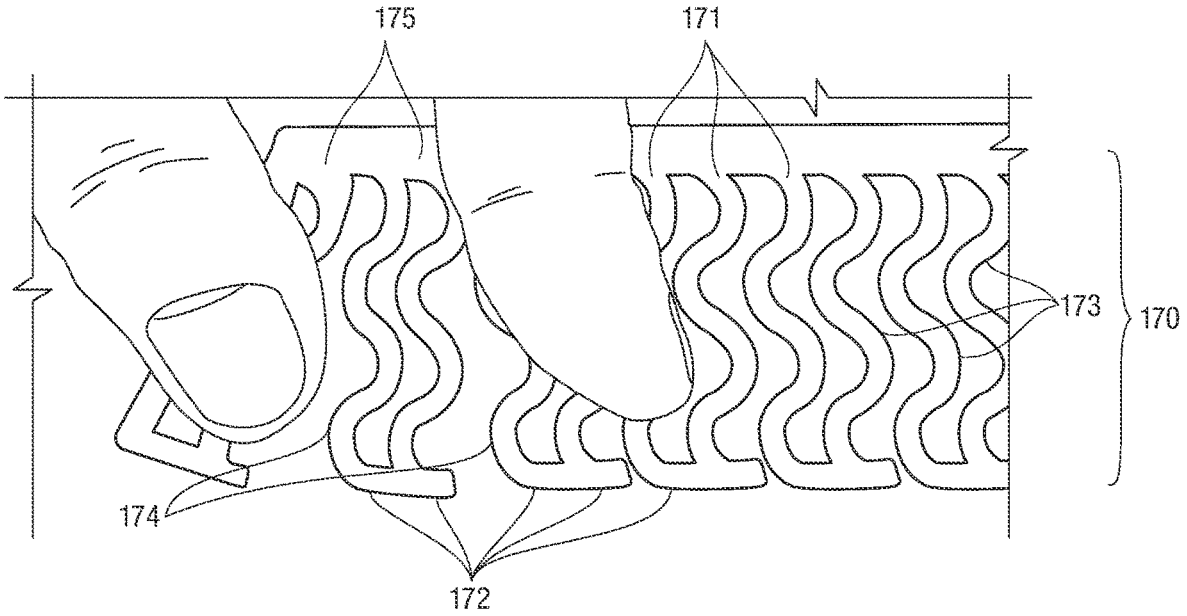
FIG. 12 shows a detail from a side plan view of a layer of bristles as an aspect of the present disclosure.
Figure 13:
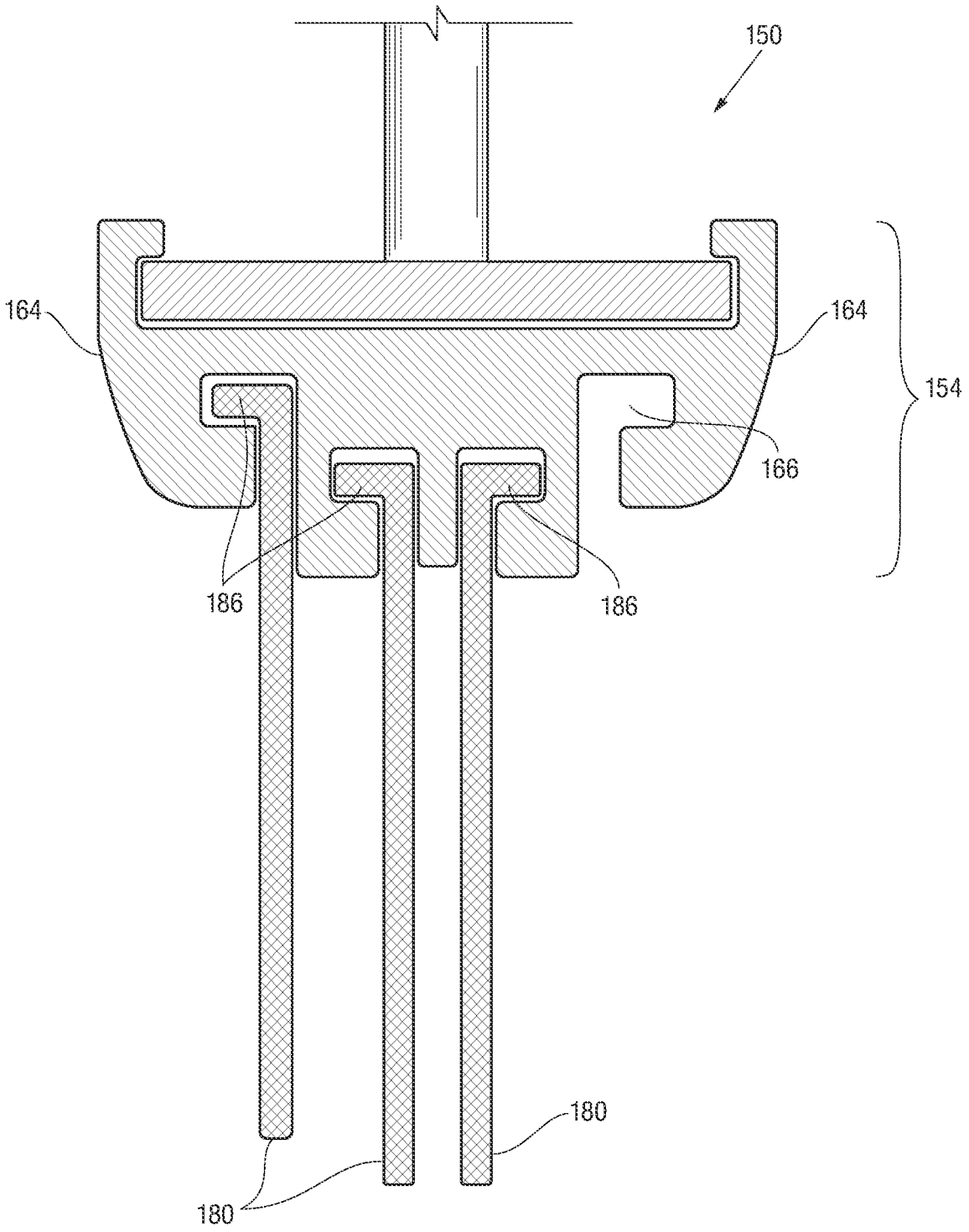
FIG. 13 shows an end elevation view of a brush head as an aspect of the present disclosure.
Figure 14:
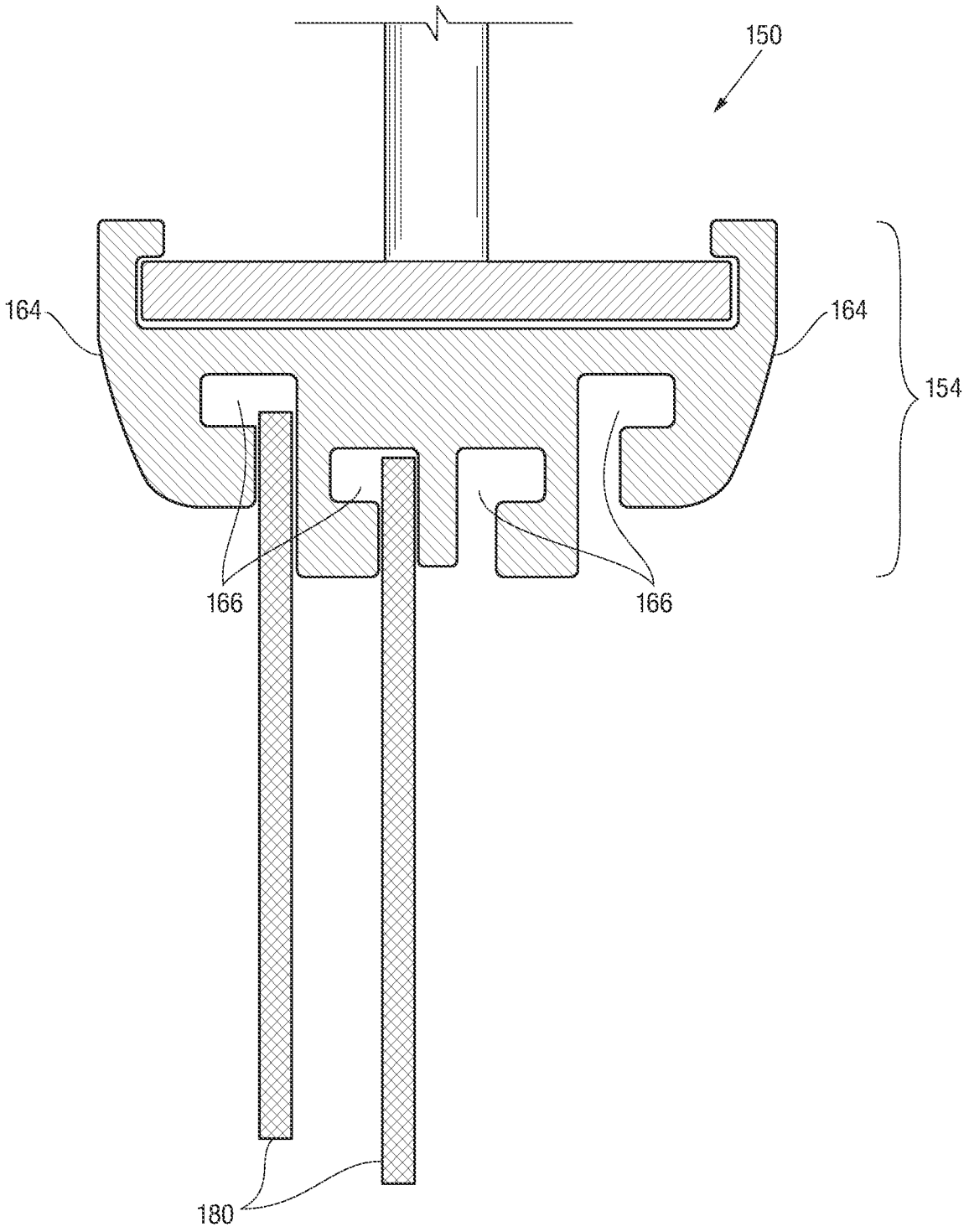
FIG. 14 shows an end elevation view of a brush head as an aspect of the present disclosure.
Figure 15:
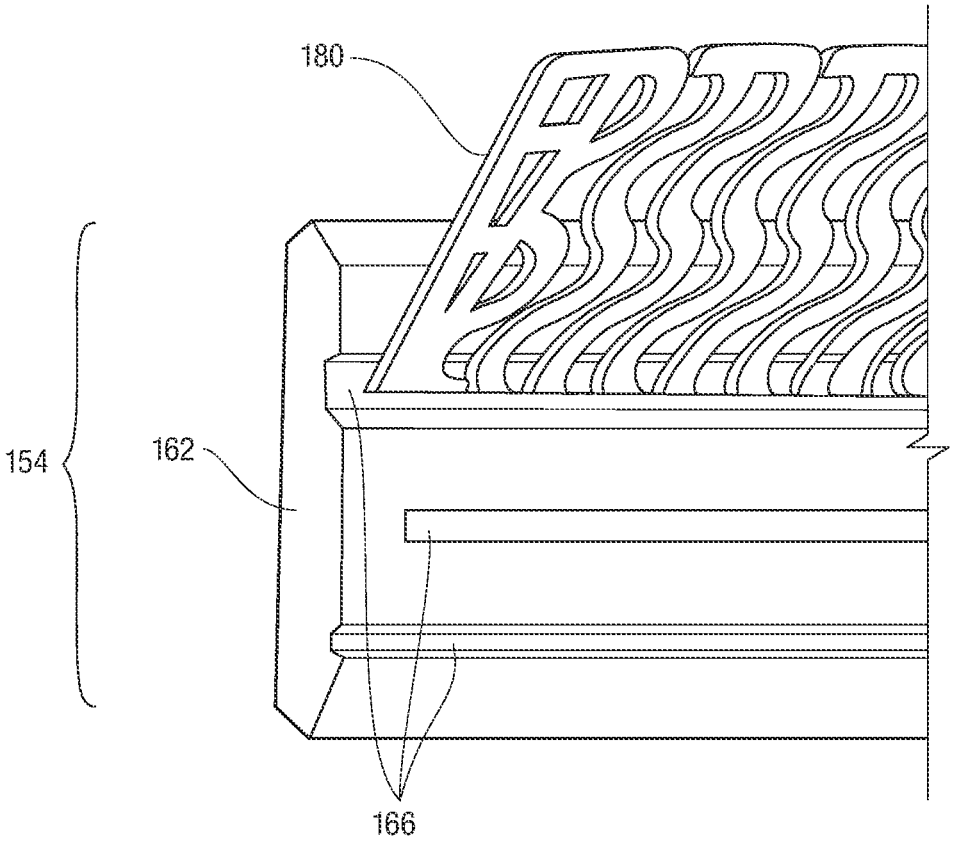
FIG. 15 shows a bottom perspective view of a brush head as an aspect of the present disclosure.
Figure 16:
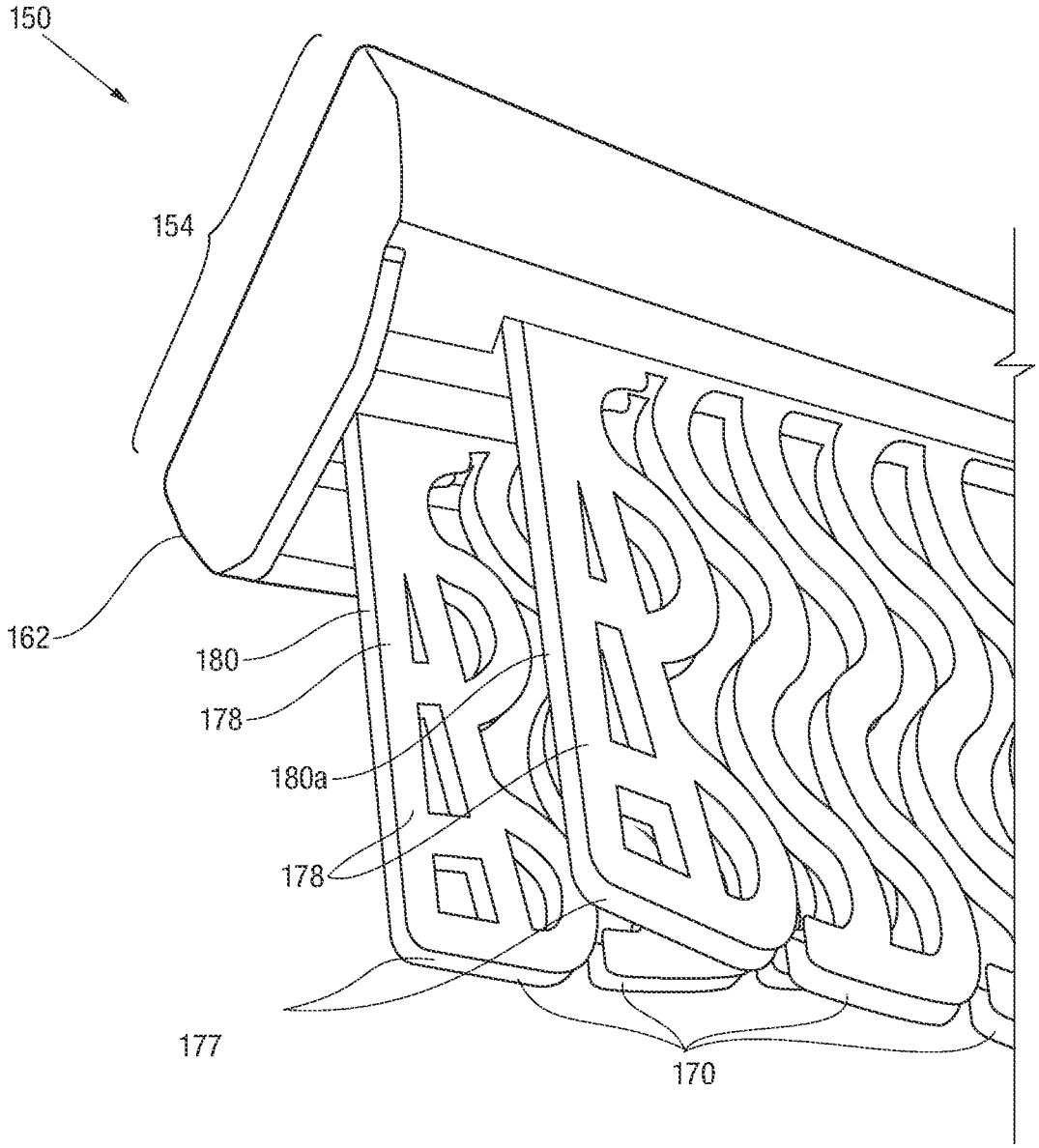
FIG. 16 shows a bottom perspective view of a brush head as an aspect of the present disclosure.
Figure 17:
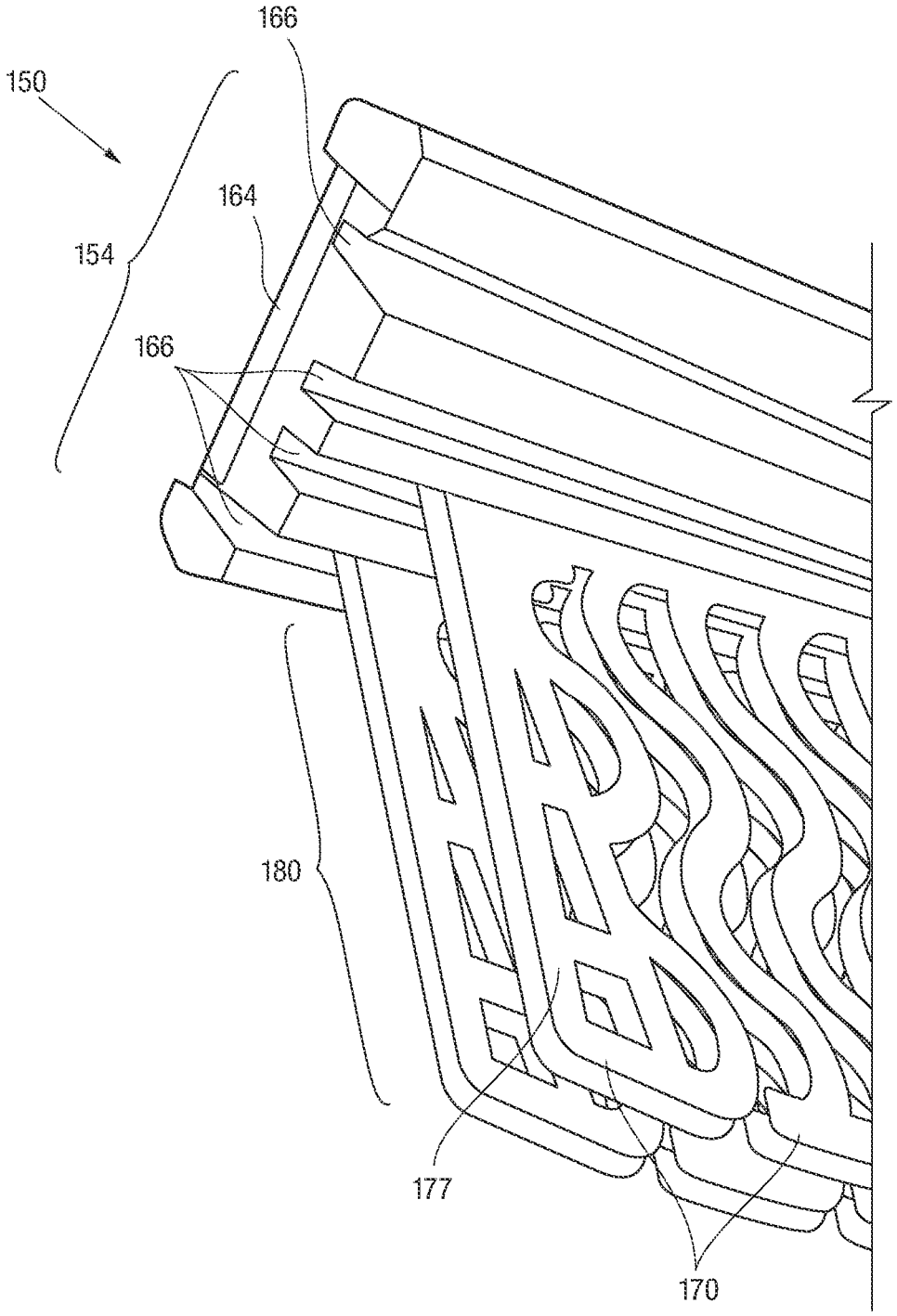
FIG. 17 shows a bottom perspective view of a brush head as an aspect of the present disclosure.
Figure 18:
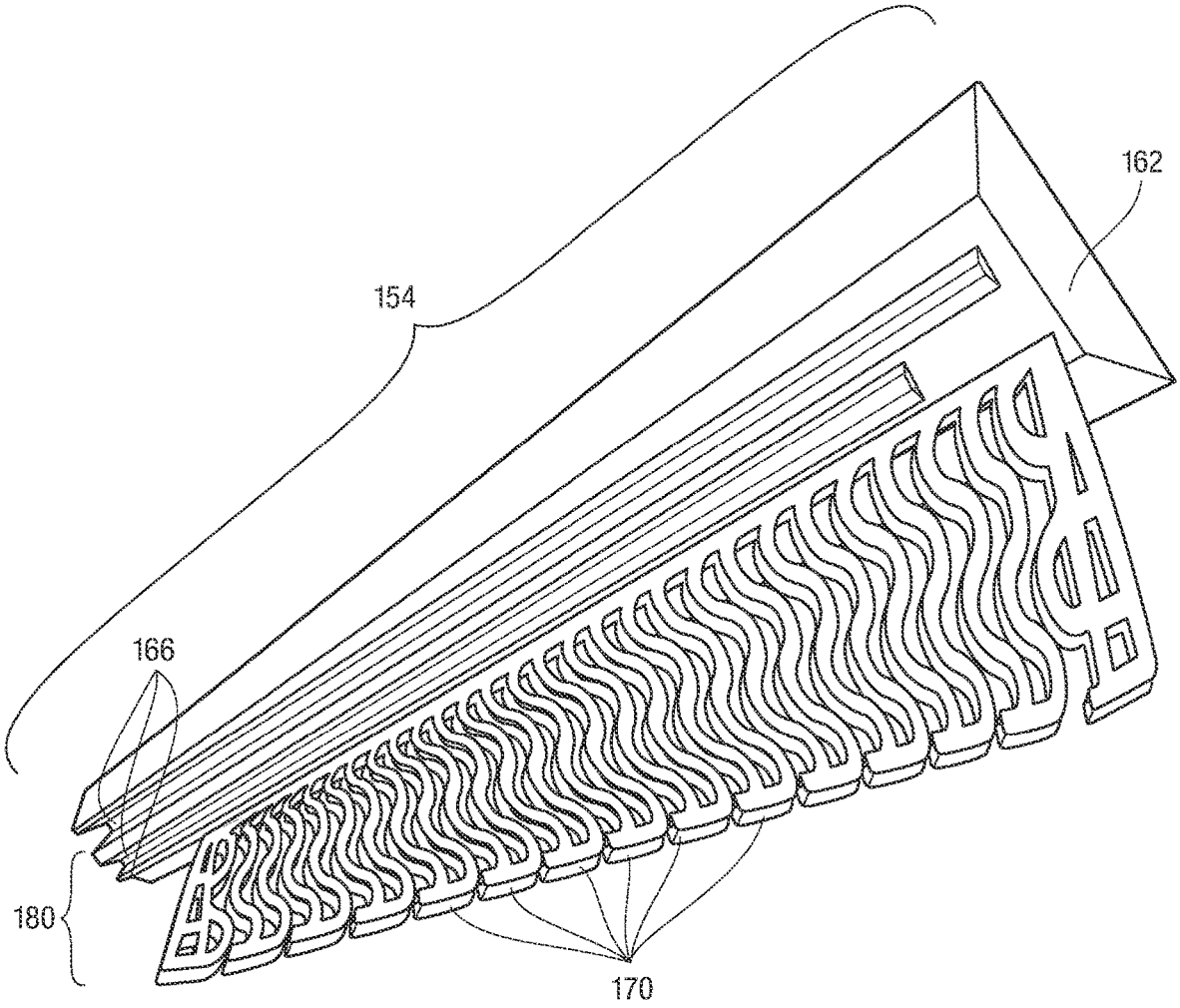
FIG. 18 shows a side-and-bottom perspective view of a brush head as an aspect of the present disclosure.

Each of the plurality of shaped bristles 170 may comprise a top 171, a bottom 172, a first side 173, a second side 174, a first surface 175, and a second surface 176, any of which may be referred to herein in the singular, or in the plural, or as a plurality of the foregoing. The plurality of shaped bristles 170 may be attached at the top 171 of each of the plurality of shaped bristles 170 to each other, as shown in FIG. 11, FIG. 12, FIG. 15, FIG. 16, FIG. 17, and FIG. 18, comprising a layer 180 of the plurality of shaped bristles 170. The plurality of shaped bristles 170 may be attached to a broom head or to the brush 150, or to the brush frame 154. At the bottom 172 of each of the plurality of shaped bristles 170, each of the plurality of shaped bristles 170 may be attached to one or more adjacent of the plurality of shaped bristles 170, as shown in FIG. 11, FIG. 12, FIG. 15, FIG. 16, FIG. 17, and FIG. 18, comprising a layer 180 of the plurality of shaped bristles 170. Alternatively, or in addition, a layer 180 may be formed by attaching a plurality of shaped bristles 170 at the top 171 of each of the plurality of shaped bristles 170. The plurality of shaped bristles 170 may be attached to each other in a pattern 182. A pattern 182 may comprise, but is not limited to, every other of the plurality of shaped bristles 170 so that they are attached in pairs, or in triplets, or quartets, or other groups, or attached in sequences that are abbreviated as 2-1-2-1, or 3-2-1-3-2-1, or 4-2-3-1-4-2-3-1, or in any other arrangement of a pattern 182. Any given plurality of shaped bristles 170 may comprise a plurality of layer-end-bristles 177, wherein the plurality of layer-end-bristles 177 are the bristles at the respective ends of the layer 180. The plurality of layer-end-bristles 177 may comprise a substantially different shape than some, most, or nearly all of the shaped bristles 170 in the layers 180. The plurality of layer-end-bristles 177 may comprise a bristle-outer-brace-portion 178, which may serve to help the shaped bristles 170 and the layers 180 maintain their respective shapes and thus their function. Note that FIG. 12 presents fingers in the view, both for scale and to show the relative shapes and flexing of the plurality of shaped bristles 170. The plurality of shaped bristles 170 may comprise an elastic material.

The foregoing attachment configuration of the plurality of shaped bristles 170 gives the plurality of shaped bristles 170, as a layer 180, a squeegee effect and offers improvements in efficiency and effectiveness of use, by leaving less dust behind per sweep when used. In some aspects of the present disclosure, any subset of the plurality of shaped bristles 170 may be attached to each other both at the top 171 and the bottom 172 of the plurality of shaped bristles 170 to comprise a layer 180.

With further reference to FIG. 11, FIG. 12, FIG. 13, FIG. 14, FIG. 15, FIG. 16, FIG. 17, and FIG. 18, in some aspects of the present disclosure, any subset of the plurality of shaped bristles 170 may be attached to each other only at the bottom 172 to comprise a layer 180. A brush 150 of the present disclosure may comprise a plurality of layers 180. The number of the plurality of layer 180 may be one layer 180, or two layers 180, or three layers 180, or four layers 180, or any number of layers 180; wherein each layer 180 has at least one layer 180 to which it is adjacent, referred to as an adjacent layer 180*a*. In aspects of the present disclosure with the plurality of layers 180 comprising multiple layers, and where at least some of the plurality of shaped bristles 170 have a shape that is non-symmetrical, e.g., a curve or curves oriented to one side, referred to as handedness 184 of the layer 180, some or all of the plurality of layers 180 may be arranged with handedness 184 in a particular orientation or orientations. An arrangement of the orientations of the plurality of layers 180 with alternating, varied, or offset handedness 184 serves to provide improved elasticity and resiliency of the plurality of layers 180, making the brush 150 made with such an arrangement more effective at the desired cleaning task.

The brush frame 154 may further comprise a brush-bristle-stop-end 162 and a brush-bristle-open-end 164. Each or any of the plurality of layers 180 may be attached at their top—the top being the side or aspect farthest from the floor—to form such one of the plurality of layers 180. Each such of the plurality of layers 180 may further comprise a layer top 186, together a plurality of layer tops 186, and advantageously, the brush frame 154 may further comprise a plurality of layer-top-retainers 166, wherein at least some of the plurality of layer tops 186 and the layer-top-retainers 166 are disposed to securely and reversibly fit together. As shown in FIG. 13, FIG. 14, FIG. 15, FIG. 16, FIG. 17, and FIG. 18, the layer top 186 may be slid into, locked into, pressed into, clipped into, or otherwise engaged with, the layer-top-retainers 166. This may be done for any number of layer tops 186 and layer-top-retainers 166. In such aspects of the present disclosure, the plurality of layers 180 may be engaged with the brush frame 154 by sliding the layer top 186 of each of the plurality of layers 180 into one of the layer-top-retainers 166, from the brush-bristle-open-end 164 to the brush-bristle-stop-end 162.

In aspects of the present disclosure wherein the handedness 184 alternates from one layer 180 to an adjacent layer 180*a*, the plurality of layers 180 have additional strength or resistance when used to sweep, either pushed or pulled, which offers improvements in the efficiency of use of the brush 150 of the folding broom-cleaning-storage apparatus 100, and helps to prevents the shaped bristles 170 from bending out of shape. In aspects of the present disclosure wherein the pattern 182 of the plurality of layers 180 varies from one layer 180 to an adjacent layer 180*a*, the plurality of layers 180 have additional strength or resistance when used to sweep, either pushed or pulled, which offers improvements in the efficiency of use of the brush 150 of the folding broom-cleaning-storage apparatus 100, and helps to prevents the shaped bristles 170 from bending out of shape. The plurality of shaped bristles 170, and the plurality of layers 180, may be implemented separately from other aspects of the present disclosure.

Certain aspects of the present invention were described above. From the foregoing it will be seen that this invention is one well adapted to, capable of, designed to, and/or configured to attain all the ends and objects set forth above, together with other advantages, which are obvious and inherent to the system and method of the present invention. It will be understood that certain features and sub-combinations are of utility and may be employed without reference to other features and sub-combinations. It is expressly noted that the present invention is not limited to those aspects described above, but rather the intention is that additions and modifications to what was expressly described herein are also included within the scope of the invention. Moreover, it is to be understood that the features of the various aspects described herein are not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

Accordingly, what is claimed is:

1. A folding broom-cleaning-storage apparatus, comprising:

a case comprising a bottom, a first side, a second side, a back-side, a top, a cover, and a cover-handle receiver; the case comprising a front opening; and wherein the cover is rotatably affixed to the case with a cover hinge;

a handle, the handle comprising: a proximal end and a handle-cover coupler situated at the proximal end; a distal end and a handle-brush coupler situated at the distal end; and a plurality of handle-sections which are hollow; and a handle-elastic-item running through the plurality of handle-sections; and a brush, the brush comprising: a plurality of bristles; a brush frame; and a brush-handle shaft; and a brush axis; wherein the brush-handle shaft reversibly couples with the handle-brush coupler; and wherein the plurality of bristles comprises a plurality of shaped bristles, and wherein each of the plurality of shaped bristles comprises a top, a bottom, a first side, a second side, a first surface, and a second surface, and the plurality of shaped bristles are attached at the top of each of the plurality of shaped bristles to each other, comprising a layer of the plurality of shaped bristles, and wherein each of the plurality of shaped bristles are attached to one or more adjacent shaped bristles, of the plurality of shaped bristles, at the bottoms of the shaped bristles; and wherein the brush comprises a plurality of layers, and wherein at least some of the plurality of shaped bristles of a first layer of the plurality of layers are non-symmetric, so that the first layer has non-symmetric shaped bristles oriented in a particular direction, and wherein some or all of the plurality of layers are arranged with the non-symmetric shaped bristles of each such layer in the particular orientation of each such layer.

2. A folding broom-cleaning-storage apparatus, comprising:

a case comprising a bottom, a first side, a second side, a back-side, a top, a cover, and a cover-handle receiver; the case comprising a front opening; and wherein the cover is rotatably affixed to the case with a cover hinge;

a handle, the handle comprising: a proximal end and a handle-cover coupler situated at the proximal end; a distal end and a handle-brush coupler situated at the distal end; and a plurality of handle-sections which are hollow; and a handle-elastic-item running through the plurality of handle-sections; and a brush, the brush comprising: a plurality of bristles; a brush frame; and a brush-handle shaft; and a brush axis; wherein the brush-handle shaft reversibly couples with the handle-brush coupler; and wherein the plurality of bristles comprises a plurality of shaped bristles, and wherein each of the plurality of shaped bristles comprises a top, a bottom, a first side, a second side, a first surface, and a second surface, and the plurality of shaped bristles are attached at the top of each of the plurality of shaped bristles to each other, comprising a layer of the plurality of shaped bristles, and wherein each of the plurality of shaped bristles are attached to one or more adjacent shaped bristles, of the plurality of shaped bristles, at the bottoms of the shaped bristles; and wherein the brush comprises a plurality of layers, and each of the plurality of layers comprises a layer top, together a plurality of layer tops; and wherein the brush frame comprises a plurality of layer-top-retainers, wherein each of the plurality of layer tops and at least one of the plurality of layer-top-retainers are disposed to securely and reversibly fit together, and wherein the brush frame comprises a brush-bristle-stop-end and a brush-bristle-open-end.

* * * * *